US009335667B1

(12) United States Patent
Zona et al.

(10) Patent No.: US 9,335,667 B1
(45) Date of Patent: May 10, 2016

(54) CARRIER FOR TWO COMPONENT DEVELOPMENT SYSTEM

(71) Applicant: XEROX CORPORATION, Norwalk, CT (US)

(72) Inventors: Michael F. Zona, Webster, NY (US); Brian S. Giannetto, Livonia, NY (US); Bernard A. Kelly, Ontario, NY (US); Brian E. Moore, Ontario, NY (US); Juan A. Morales-Tirado, Henrietta, NY (US); Samir Kumar, Pittsford, NY (US); Elizabeth K. Priebe, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/677,327

(22) Filed: Apr. 2, 2015

(51) Int. Cl.
*G03G 15/09* (2006.01)
*G03G 9/083* (2006.01)

(52) U.S. Cl.
CPC ..... *G03G 15/0921* (2013.01); *G03G 9/0838* (2013.01); *G03G 15/09* (2013.01); *G03G 15/0928* (2013.01); *G03G 2215/0609* (2013.01); *G03G 2215/0634* (2013.01)

(58) Field of Classification Search
CPC ..... G03G 15/09
USPC ..... 399/27, 28, 277
See application file for complete search history.

(56) References Cited

U.S. PATENT DOCUMENTS 3,590,000 A 6/1971 Palermiti et al.
3,655,374 A 4/1972 Palermiti et al.
3,720,617 A 3/1973 Chatterji et al.
3,944,493 A 3/1976 Jadwin et al.
3,983,045 A 9/1976 Jugle et al.
4,007,293 A 2/1977 Mincer et al.
4,079,014 A 3/1978 Burness et al.
4,295,990 A 10/1981 Verbeek et al.
4,394,430 A 7/1983 Jadwin et al.
4,560,635 A 12/1985 Hoffend et al.
4,935,326 A 6/1990 Creatura et al.
4,937,166 A 6/1990 Creatura et al.
6,355,391 B1 * 3/2002 Van Dusen ..... C09C 1/56 428/402
6,593,049 B1 * 7/2003 Veregin ..... G03G 9/08782 430/108.1
6,756,176 B2 * 6/2004 Stegamat ..... C08G 63/916 430/137.1
6,830,860 B2 12/2004 Sacripante et al.
7,507,513 B2 3/2009 Tong et al.
7,507,515 B2 * 3/2009 Winters ..... G03G 9/0808 430/107.1
7,507,517 B2 3/2009 Wolfe et al.
8,178,269 B2 * 5/2012 Zhou ..... G03G 9/0804 430/108.1
8,178,274 B2 * 5/2012 Agur ..... G03G 9/0804 430/108.1

(Continued)

OTHER PUBLICATIONS

R. B. Goldfarb and F. R. Fickett, U.S. Department of Commerce, National Bureau of Standards, Boulder, Colorado 80303, Mar. 1985, NBS Special Publication 696.*

*Primary Examiner* — Clayton E Laballe
*Assistant Examiner* — Kevin Butler
(74) *Attorney, Agent, or Firm* — Pillsbury Winthrop Shaw Pittman LLP

(57) ABSTRACT

A two component development system includes a plurality of toner particles that include a colorant and a plurality of toner carrier particles that include a magnetic carrier core having a $D_{50}$ diameter in a range from about 30 microns to about 40 microns, and a surfactant-polymer coating, the coating being present in an amount in a range from about 0.5 percent by weight to about 1.5 percent by weight of the toner carrier particle.

17 Claims, 4 Drawing Sheets

(56) References Cited

U.S. PATENT DOCUMENTS

| | | | | |
|---|---|---|---|---|
| 8,221,948 | B2 * | 7/2012 | Zhou | G03G 9/0804 430/109.4 |
| 8,221,951 | B2 * | 7/2012 | Zhou | G03G 9/0804 430/108.14 |
| 8,980,519 | B2 * | 3/2015 | Morales-Tirado | G03G 9/0825 430/123.51 |
| 2003/0235773 | A1 * | 12/2003 | Skorokhod | G03G 9/113 430/111.1 |
| 2008/0193869 | A1 * | 8/2008 | Vanbesien | G03G 9/0804 430/108.4 |
| 2009/0142688 | A1 * | 6/2009 | Giannetto | G03G 9/1133 430/111.1 |
| 2012/0129088 | A1 * | 5/2012 | Kmiecik-Lawrynowicz | G03G 9/0819 430/108.3 |
| 2012/0129089 | A1 * | 5/2012 | Kmiecik-Lawrynowicz | G03G 9/0819 430/108.3 |
| 2014/0162181 | A1 * | 6/2014 | Kmiecik-Lawrynowicz | G03G 9/0806 430/108.21 |
| 2014/0162184 | A1 * | 6/2014 | Kmiecik-Lawrynowicz | G03G 9/08782 430/108.23 |

* cited by examiner

CARRIER FOR TWO COMPONENT DEVELOPMENT SYSTEM

BACKGROUND

The present disclosure relates to two component systems for delivery of toner. In particular, the present relates to carriers used in two component systems Xerographic development systems normally fall into two categories, those that use a combination of carrier particles and toner particles for two component developer material and those that use only toner particles for the developer material. In two component development systems, the carrier particles are usually magnetic and the toner particles are usually non-magnetic, but triboelectrically adhere to the carrier particles. The toner particles are attracted to the electrostatic latent image from the carrier particles and form a toner particle image on a photoreceptor surface. Most two component development systems incorporate a permeability sensor in the architecture to monitor the toner concentration within a development housing in order to control the xerographic set points to enable optimal image quality characteristics on the final substrate.

SUMMARY

In some aspects, embodiments herein relate to two component development systems comprising a plurality of toner particles comprising a colorant and a plurality of toner carrier particles comprising a magnetic carrier core having a $D_{50}$ diameter in a range from about 30 microns to about 40 microns, and a surfactant-polymer coating, the coating being present in an amount in a range from about 0.5 percent by weight to about 1.5 percent by weight of the toner carrier particle.

In some aspects, embodiments herein relate to two component development systems comprising a plurality of toner particles comprising a colorant, and a plurality of toner carrier particles comprising a magnetic carrier core having a $D_{50}$ diameter in a range from about 30 microns to about 40 microns, and a sodium lauryl sulfate-poly(methylmethacrylate), (SLS-PMMA) coating, the coating being present in an amount in a range from about 0.5 percent by weight to about 1.5 percent by weight of the toner carrier particle.

In some aspects, embodiments herein relate to two component development systems comprising a plurality of toner particles comprising a colorant, wherein a silica with an average primary particle size of about 30 nm to about 50 nm and a silica with an average primary particle size of about 110 nm to about 130 nm are used as an external toner additive in a ratio of about 1:1, and a plurality of toner carrier particles comprising a magnetic carrier core having a $D_{50}$ diameter in a range from about 30 microns to about 40 microns, and a sodium lauryl sulfate-poly(methylmethacrylate), (SLS-PMMA) coating, the coating being present in an amount in a range from about 0.5 percent by weight to about 1.5 percent by weight of the toner carrier particle.

BRIEF DESCRIPTION OF DRAWINGS

Various embodiments of the present disclosure will be described herein below with reference to the figures wherein.

DETAILED DESCRIPTION

Figure 1:
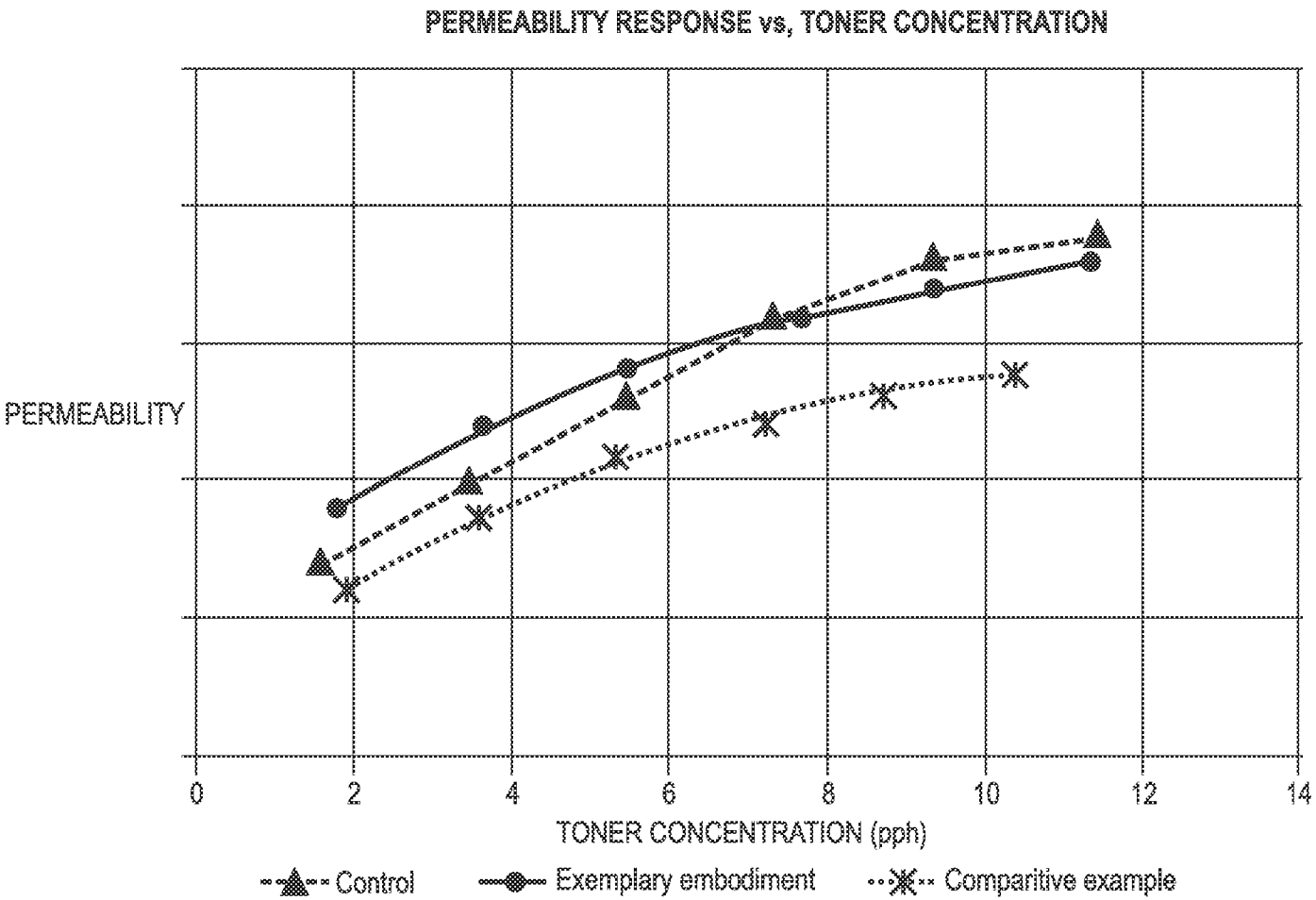
FIG. 1 shows a plot of developer permeability versus toner concentration (TC, in parts per hundred (pph)) for a two component development system employing toner carrier particles in accordance with embodiments herein.

Embodiments herein relate generally to toner carrier particles employed in two component toner development systems. The toner carrier particle designs disclosed herein provide excellent flow characteristics while providing desirable developer permeability and toner charging properties.

The aftermarket printing industry relies on materials and hardware designs that can be used in existing print engines to provide lower cost and comparable quality to the original equipment manufacturer (OEM) materials and components used in the existing machines. To incorporate new developer materials into an existing xerographic architecture requires that they work within the operating framework of the machine's material delivery hardware and the existing process control algorithms so that the print/copy performance is comparable to the OEM materials performance. Because the OEM hardware and process control algorithms cannot be adjusted to accommodate variation in aftermarket developer materials, care must be taken in designing aftermarket materials to work effectively within the OEM design hardware and process control parameters. One area of design focus is the developer material permeability. Most machines incorporate a permeability sensor to monitor the ratio of toner particles to carrier beads within a development housing in a two component xerographic system. This ratio, termed "toner concentration" or "TC" in the industry, is used to make xerographic process control adjustments based on environmental conditions, developer age, and the like. The TC is a significant driver in achieving the desired toner charge characteristics for the development system. Typically, as the TC goes down (less toner parts per carrier bead parts) in the development housing, the charge of the toner particles increases and the amount of toner particles available to develop the latent image is reduced. Conversely, as the TC goes up (more toner per carrier beads), the charge of the toner particles is reduced and the amount of toner available to develop the latent image is increased. If the TC is too high, the toner charge becomes so low, and the toner amount becomes so high, that the toner particles do not electrostatically adhere to the carrier beads and emit from the development housing to create "dirt" within the machine cavity that erodes quality. Given the inability to modify the machine hardware and/or the machine's process control algorithms, it is important that the developer material design be comparable in charging properties, as well as permeability and flowability properties, so that the machine process control does not try to make adjustments outside its capability limits, leading to poor print/copy quality and/or create a dirty/contaminated machine cavity. Embodiments herein provide methods to adjust the permeability of the developer material comprising modifying the carrier magnetic properties, without having a substantial impact on the toner charging properties, so that the developer material can be installed in an existing machine architecture and produce comparable print/copy performance to OEM materials, without requiring any adjustments to hardware or process control algorithms.

In embodiments, there are provided toner carrier particles comprising a magnetic carrier core having a $D_{50}$ diameter in a range from about 30 microns to about 40 microns, a bulk density of about 2.0 to about 2.5 grams per cubic centimeter, mass flow of 5.0 to 9.0 grams per second using a Carney cup with orifice diameter of 0.2 inch/5.0 mm, the magnetic core having a magnetization in a range from about 40 emu per gram to about 50 emu per gram, and a coating disposed about the magnetic carrier core, the coating being present in an amount in a range from about 0.5 percent by weight to about 1.5 percent by weight of the toner carrier particle and the coating consisting essentially of a single surfactant-polymer composition.

Toner Carrier Particles

In embodiments, the magnetic core of the toner carrier particles has a $D_{10}$ diameter in a range from about 20 microns to about 30 microns, or from about 23 microns to about 27 microns. In embodiments, the magnetic core has a $D_{90}$ diameter in a range from about 45 microns to about 50 microns, or from about 46 microns to about 49 microns. In embodiments, the magnetic carrier core has an average diameter of about 35 microns.

In embodiments, the magnetic carrier core is a magnesium-manganese alloy. In embodiments, the magnetic core carrier may comprise ferrite.

Examples of carrier particles that can be utilized for mixing with the toner particles include those which are capable of triboelectrically obtaining a charge of opposite polarity to that of the toner particles. Other illustrative examples of suitable carrier particle core materials may be magnetic or not and include, without limitation, granular zircon, granular silicon, glass, steel, nickel, ferrites, iron ferrites, silicon dioxide, and the like. Other carrier core materials include those disclosed in U.S. Pat. Nos. 4,937,166, and 4,935,326.

The carrier particles disclosed herein have a magnetization of about 35 to about 55 emu per gram of carrier material. In embodiments, the magnetization is about 40 to about 50 emu per gram. In embodiments, the bulk density of the carrier particles is 2.0 to 2.5 grams per cubic centimeter. In embodiments, the mass flow of the carrier particles is 5.0 to 9.0 grams per second measured using a Carney cup with orifice diameter of 0.2 inch/5.0 mm.

Carrier particle size measurement is typically carried out as follows. A split sample of carrier powder, about 25 g to about 50 g, which is assumed to be representative of the bulk material, is provided. The particle size distribution is measured by laser diffraction using, for example, a Malvern Mastersizer X and supporting software. The volume median and specified volume parameters are readily available.

The mass flow/apparent density can be determined as follows. A split sample of about 120 g is measured using the Hall Flow Meter with Carney Cup (Alcan Ingot and Powders; Elizabeth, N.J.). The Carney Cup has an orifice diameter of 0.2 inch/5.0 mm. About 50 g of unknown material is allowed to flow through the orifice of the funnel, and the time elapsed from the start of flow to the end of flow is measured. Approximately 100 g of unknown material is passed through the funnel and into a 25 cc cup and the contents weighed for density calculation. The flow and density can be measured at the same time using the larger sample size of 100 g. The flow measurement is equivalent and may gain precision with the larger sample size, although this is not the ASTM method.

The apparent density can be determined as follows: (a) Set up Hall Flow meter with metal cup (Carney Cup) on platform and calibrated cylinder inside. Adjust height of Carney Cup to the top of the calibrated cylinder (one inch). The metal cup is used to catch any overflow from the calibrated cylinder; (b) split sample to approximately 120 g and carefully pour sample into Flowmeter funnel while blocking orifice with finger; (c) open orifice and allow powder to flow into calibrated cylinder; (d) rotate funnel portion of the Hall Flowmeter to gain access to the calibrated cylinder containing the powder sample. Using the straight edge, carefully scrape the top of the cylinder to remove excess material. Weigh cylinder and contents, determine weight of contents by difference, and record weight of contents as W1; (e) Repeat to obtain duplicate analysis as W2. Apparent density, in grams/cubic centimeter is calculated as ((W1+W2)/2) divided by the volume of the cylinder in cubic centimeters.

The mass flow can be determined as follows: (a) Set up Hall Flow meter with metal Carney Cup on platform; (b) split sample to 50 g±2 g weight. Record weight to nearest 0.1 g as $W_{zero}$. (Note: the test can be run in conjunction with the apparent density measurement with the larger 80 g or 100 g sample size.); (c) carefully pour sample into Flowmeter funnel while blocking orifice with finger; (d) open orifice and start timing device at the same time. When end trail of powder reaches orifice, stop device and record time on work sheet as A; (e) repeat step 4.2—A thru D for duplicate reading and record flow time as B; (f) optionally duplicate analysis.

The coating weight of the coated toner particle, which is not routinely measured, can be carried out as follows: Thermogravimetric analysis is used to determine coating weight. Approximately 100 g to 130 mg of carrier is placed in $Al_2O_3$ TGA crucible and analyzed using the Netzsch TGA. The test is run under nitrogen. After equilibrating for 10 minutes at 30.00° C., the sample is heated using a 50.00 00° C./min ramp to 800.00° C. The percent coating weight, such as PMMA coating, is calculated as the weight loss between 152° C. and 450° C.

The magnetic properties of the toner particles can be carried out as follows. Magnetic properties (Saturation Magnetization, Coercivity, Retentivity) are measured using a Vibrating sample magnetometer (VSM). After calibration and measuring a nickel standard and a known reference of material comparable to the sample, 0.02 to 0.05 g of sample is packed tightly in a compact sample holder. The magnetic field can be varied from −6,000 Gauss to 6,000 Gauss. Coercivity, retentivity, and magnetization are calculated by the available software.

The carrier particles disclosed herein employ a coating. In embodiments, the surfactant-polymer composition serving as a coating is sodium lauryl sulfate-poly(methylmethacrylate), (SLS-PMMA). In embodiments, the coating is present in about 1 percent by weight of the toner carrier particle, as determined according to the procedure above. In embodiments, the coating is at least 90% SLS-PMMA, or at least 95%, or at least 99%, or 100% SLS-PMMA. That is, when the coating is 100% SLS-PMMA, no other coating material is employed. In embodiments the coating consists essentially of SLS-PMMA. In embodiments, the coating consists of SLS-PMMA.

Conventional coatings which may serve as alternatives to SLS-PMMA may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight % of the coating composition. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, solvent coating, dry coating, and combinations thereof. The mixture of carrier core particles and polymer may then be heated to enable the polymer to melt and fuse to the carrier core particles. The coated carrier particles may then be cooled and thereafter classified to a desired particle size.

The carrier particles can be mixed with the toner particles in various suitable combinations. The concentrations are may be from about 1% to about 20% by weight of the toner composition. However, different toner and carrier percentages may be used to achieve a developer composition with desired characteristics.

In embodiments, there are provided two component development systems comprising a plurality of toner particles comprising a colorant and a plurality of toner carrier particles comprising a magnetic carrier core having a $D_{50}$ diameter in a range from about 30 microns to about 40 microns and a surfactant-polymer coating, the coating being present in an amount in a range from about 0.5 percent by weight to about 1.5 percent by weight of the toner carrier particle.

In some such embodiments, the magnetic core has a $D_{10}$ diameter in a range from about 20 microns to about 30 microns, the magnetic core has a D90 diameter in a range from about 45 microns to about 50 microns, or the magnetic carrier core has a diameter of about 35 microns, the magnetic carrier core comprises a magnesium-manganese alloy, the surfactant-polymer coating is sodium-lauryl sulfate-poly (methylmethacrylate), the surfactant-polymer coating is present in about 1 percent by weight of the toner carrier particle. In some such embodiments, the system is designed to operate at a toner concentration in a range from about 4 parts per hundred (pph) to about 9 parts per hundred.

In embodiments, there are provided two component development systems comprising a plurality of toner particles comprising a colorant and a plurality of toner carrier particles comprising a magnetic carrier core having a $D_{50}$ diameter in a range from about 30 microns to about 40 microns and a surfactant-polymer coating, the coating being present in an amount in a range from about 0.5 percent by weight to about 1.5 percent by weight of the toner carrier particle.

In embodiments, the system is designed to operate at a toner concentration in a range from about 4 parts per hundred (pph) to about 9 pph.

Toner Particle-Resins

In embodiments, the plurality of toner particles comprise a polyester or a styrene/acrylate polymer, or a combination of each. Any latex resin may be utilized in toner particles of the present disclosure. Such resins, in turn, may be made of any suitable monomer. Any monomer employed may be selected depending upon the particular polymer to be utilized.

In embodiments, the resins may be an amorphous resin, a crystalline resin, and/or a combination thereof. In further embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the plurality of styrene/acrylate toner particles have a D50 diameter of 5.2 to 6.0 microns with a circularity index greater than 0.970.

Additives

The toner may also include charge additives in effective amounts of, for example, from about 3 weight percent to about 10 weight percent of the toner particle, in embodiments from about 4 weight percent to about 6 weight percent of the toner. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, combinations thereof, and the like.

Further optional additives include any additive to enhance the properties of toner compositions. Included are surface additives, color enhancers, and the like. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 3 to about 10 weight percent, in embodiments from about 4 to about 6 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include both a small size and a large size treated silica. As used herein "treated" means coated with a silane compound to improve the hydrophobicity. In embodiments, the small size silica has an average primary particle size in a range from about 30 nm to about 50 nm, or about 35 nm to about 45 nm, or about 40 nm, while the large size exhibits an average particle size in a range from about 110 nm to about 130 nm, or about 115 nm to about 125 nm, or about 120 nanometers. In embodiments, the total amount of silica particles can also be selected in amounts, for example, in a range from about 1 percent by weight to about 5 percent by weight of the toner particle, in embodiments from about 2 to about 4 percent by weight of the toner particle, which additives can be added during the aggregation or blended into the formed toner product. In embodiments, the amount of the small size to large size is 45% to 55% by weight.

Other Colors

In embodiments, the toner particles of the present disclosure may be combined with other toners to produce an image. Any other toners suitable for forming images may combined with the toners of the present disclosure, including those produced by conventional melt-mixing methods, emulsion aggregation methods, phase inversion methods, combinations thereof, and the like. Exemplary methods for forming emulsion aggregation toners include those disclosed in U.S. Pat. Nos. 7,507,517, 7,507,515, 7,507,513, and U.S. Patent Application Publication No. 2008/0193869, the entire disclosures of each of which are hereby incorporated by reference in their entirety.

In embodiments, for color printing, multiple colored toners may be utilized to form images. In embodiments, these toners may include pure primary colorants of cyan, magenta, yellow, and black. In other embodiments, additional colors may be utilized, including red, blue, and green, in addition to the subtractive colors of cyan, magenta, and yellow. Other colors, including white, as well as clear toners, i.e., toners possessing no colorant, may be utilized to produce an image.

Developers

The toner particles thus obtained may be formulated into a developer composition. The toner particles may be mixed with carrier particles disclosed herein to achieve a two-component developer composition. The carrier content in the developer may be from about 10% to about 30% by weight of the total weight of the developer, in embodiments from about 10% to about 25% by weight of the total weight of the developer.

Imaging

The toner particles combined with the toner carrier particles of the present disclosure can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 120° C. to about 200° C., in embodiments from about 130° C. to about 190° C., in other embodiments from about 140° C. to about 185° C., after or during melting onto the image receiving substrate.

Thus, in embodiments, an electrostatographic machine could include at least one housing defining a chamber for storing a supply of toner therein, the toner particles as described above; an advancing member for advancing the toner on a surface thereof from the chamber of the housing in a first direction toward a latent image; a transfer station for transferring toner to a substrate, the transfer station including a transfer assist member for providing substantially uniform contact between the substrate and the transfer assist member; a developer unit for developing the latent image; and a fuser member for fusing the toner to the substrate.

In some embodiments, an imaging system of the present disclosure may include five or six colors. In some embodiments, the other colors may include cyan, magenta, yellow, black, white, and/or clear. Thus, in such a case, an imaging system may include a developer unit possessing five or six different housings, with a different color toner in each housing.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Two developer materials were made according to the properties shown in Table 1 below.

TABLE 1

| Property | Working Example 1 | Comparative Example 1 |
|---|---|---|
| Toner Carrier average particle size (microns) | 35 | 35 |
| Toner Carrier Saturation Magnetization (emu/g) | 44 | 67 |
| Toner Particle average size (microns) | 5.5 | 5.5 |
| Toner Particle average circularity | .980 | .962 |
| Total Weight of small Silica % wt/wt | 1.75 | 1.4 |
| Total Weight of Large Silica % wt/wt | 1.75 | 0 |

Figure 2A:
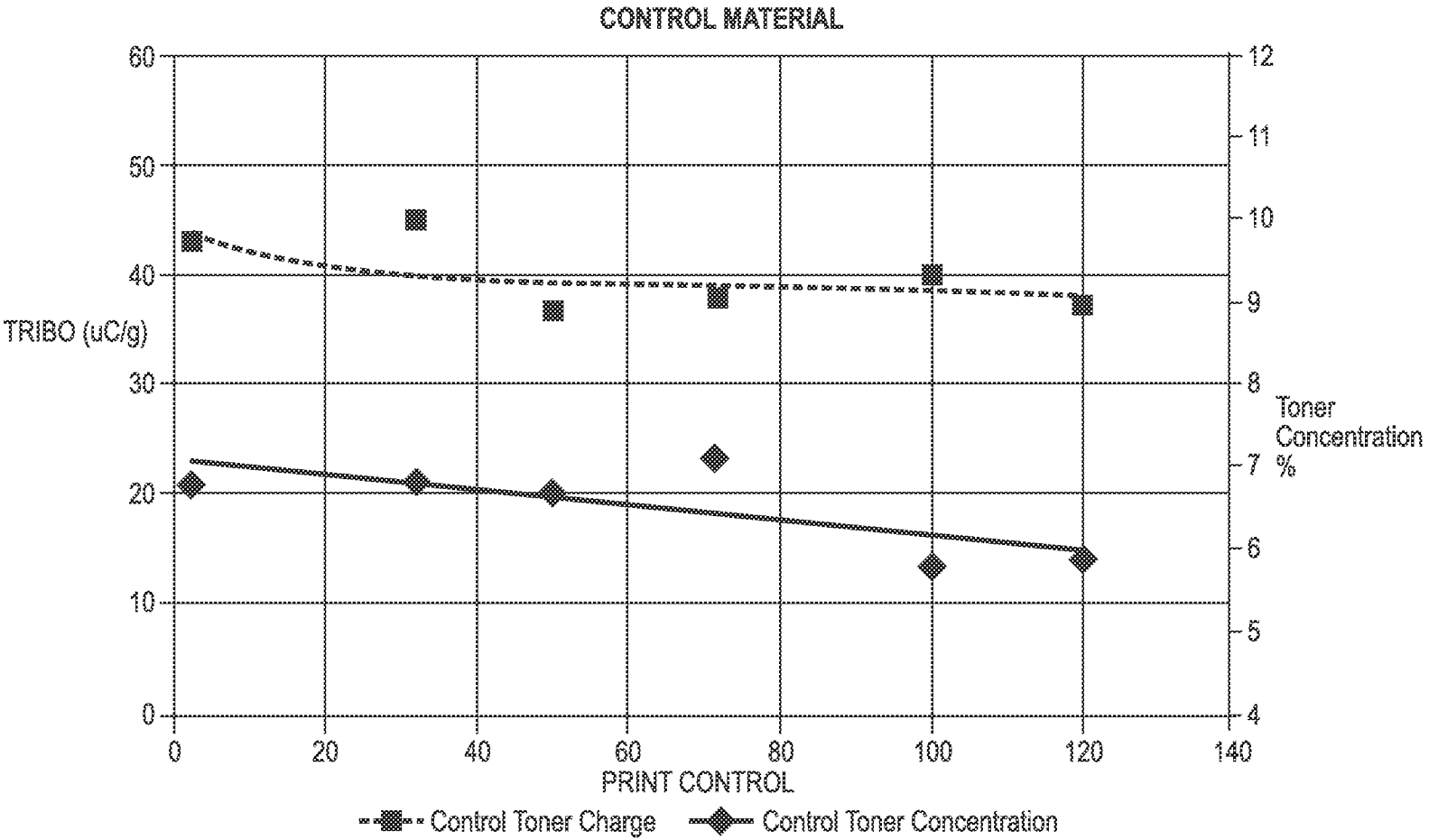
FIG. 2A shows a plot of triboelectric charge and toner concentration versus print count for a control developer material.
Figure 2B:
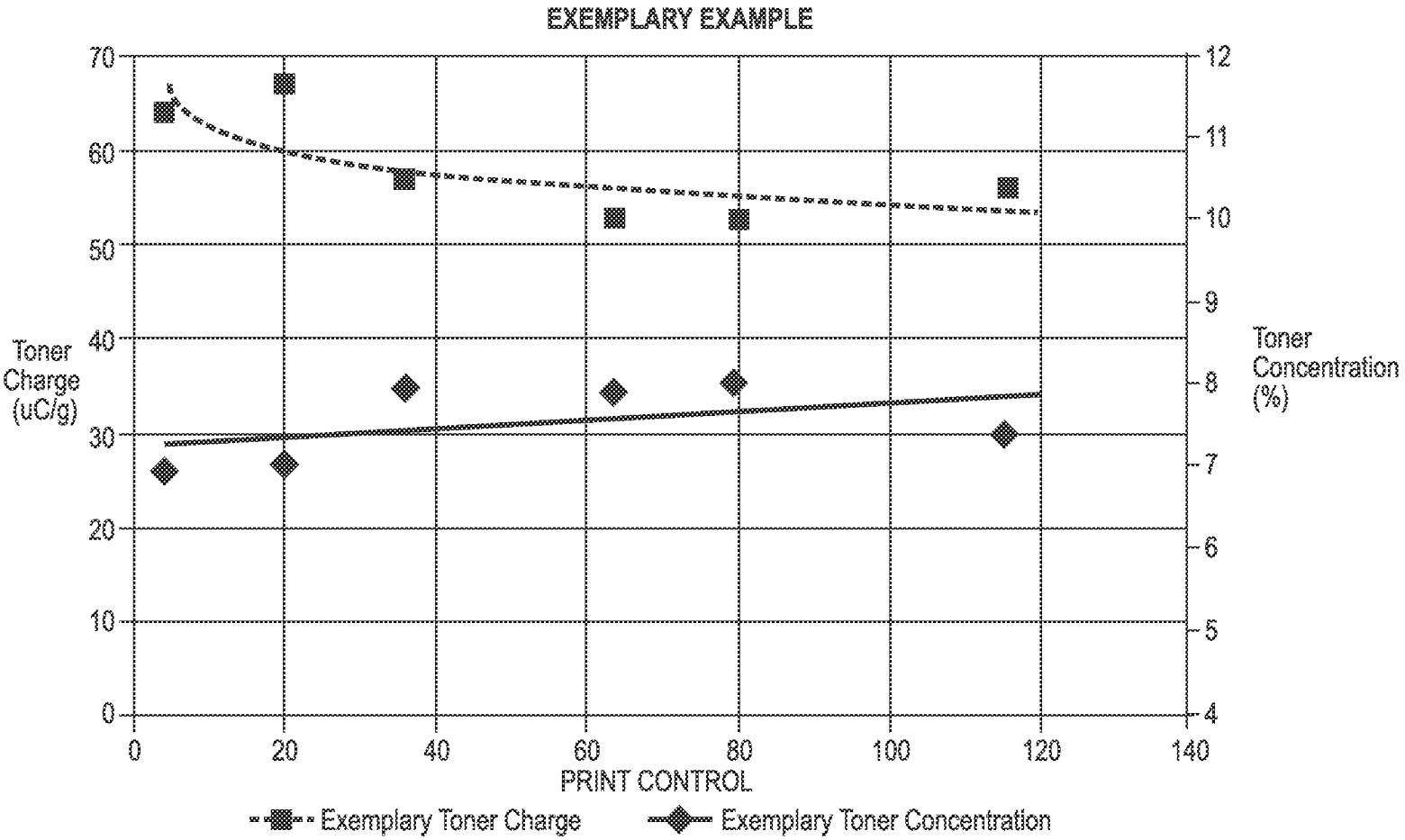
FIG. 2B shows a plot of triboelectric charge and toner concentration versus print count for an exemplary embodiment.
Figure 2C:
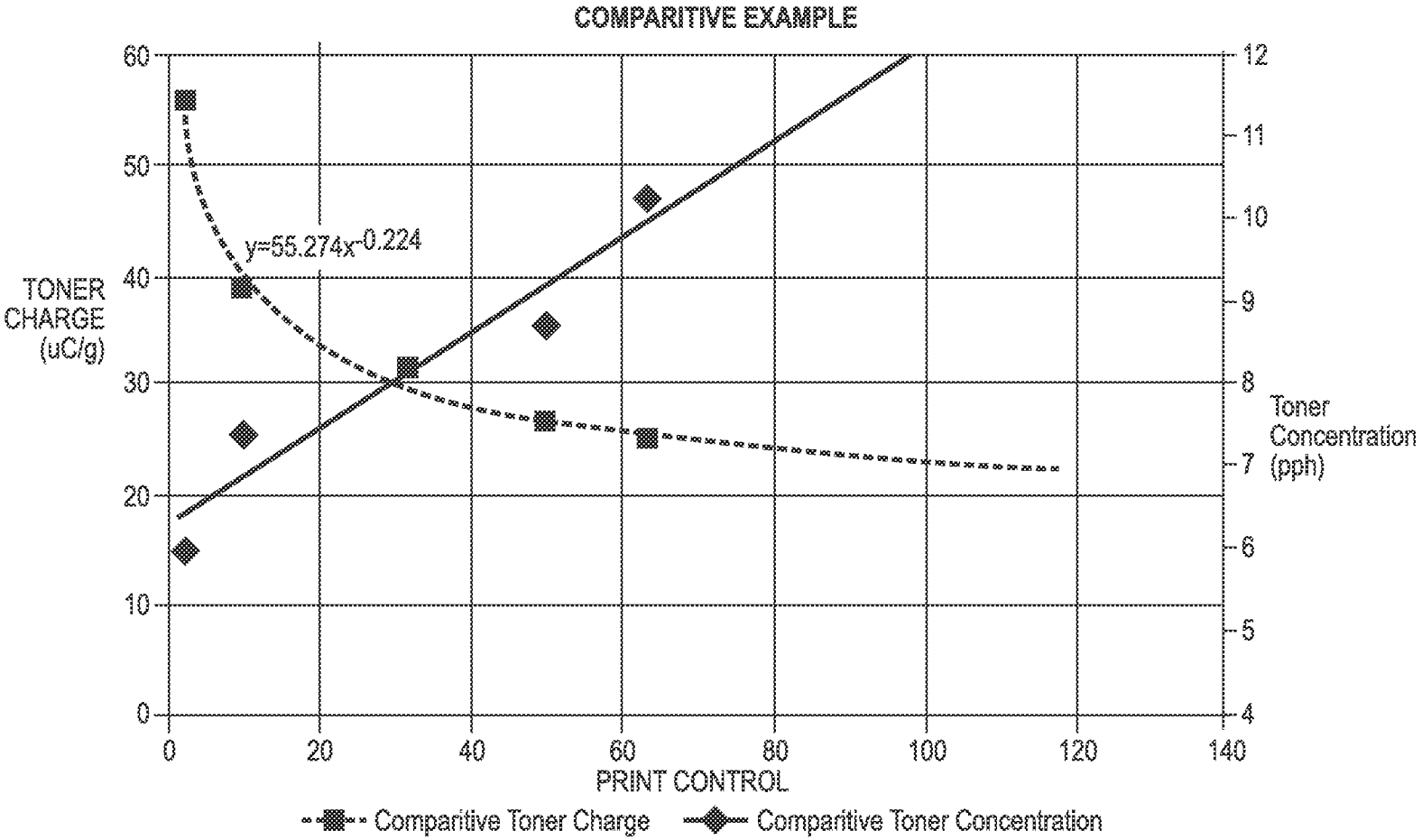
FIG. 2C shows a plot of triboelectric charge and toner concentration versus print count for a comparative example.

Each material was installed into a Bizhub C224 developer housing (Konica Minolta, Japan). Both materials were compared to a control developer material that came with the test printer. In this test, 160 grams of carrier material was loaded into a development housing while the material augers and development roll were rotated at the machine's operating speed. Then toner was added to the housing in two gram increments. At each addition, the permeability and toner concentration was recorded and plotted in FIG. 1. The material with the higher magnetization of carrier and less circular toner particle showed a much flatter response in permeability as the toner concentration increased in the housing. The exemplary developer formulation shows a much closer response in permeability to the control material. Each of these materials was then installed into the printer and the toner charge and toner concentration were monitored with generating prints to ensure the machine's process control algorithm would enable acceptable machine performance. FIG. 2A shows the charge and TC response of the control developer material from Konica Minolta. FIG. 2B shows similar data for the material made according to the Working Example 1 in Table 1 above. In this case the toner concentration remained stable over the 60,000 pages that were generated. The toner concentration was also very similar in magnitude to the control material. Although the toner charge of the Working Example was ten to fifteen microcoulombs per gram higher than the Comparative Example control material, the machine's process control was able to adjust the process accordingly to make images that were comparable to the control images. FIG. 2C shows the data for the Comparative Example material made to the properties shown in Table 1. For this Comparative Example, the toner concentration was unstable and increased as more pages were generated. This increase in toner concentration caused the toner charge to drop dramatically as more pages were generated, creating excessive amounts of toner contamination within the machine internal cavity. This toner emission from the developer housing lead to contamination of critical xerographic components that eventually caused very poor image quality.

What is claimed is:

1. A two component development system comprising
a plurality of toner particles comprising a colorant; and
a plurality of toner carrier particles comprising
a magnetic carrier core having a $D_{50}$ diameter in a range from about 30 microns to about 40 microns; and a surfactant-polymer coating, the coating being present in an amount in a range from about 0.5 percent by weight to about 1.5 percent by weight of the toner carrier particle, wherein the system is designed to operate at average toner charge in a range from about 30 to 70 micro coulombs per gram.

2. The two component development system of claim 1, wherein the magnetic carrier core comprises a magnesium-manganese alloy.

3. The two component development system of claim 1, wherein the magnetic carrier core has a diameter of about 35 microns.

4. The two component development system of claim 1, wherein the saturation magnetization of carrier core is in a range from about 40 to about 50 emu per gram.

5. The two component development system of claim 1, wherein the magnetic carrier core has a bulk density of about 2.0 to about 2.5 grams per cubic centimeter.

6. The two component development system of claim 1, wherein the magnetic carrier core has a mass flow in a range from about 5.0 to about 9.0 grams per second using a Carney cup with orifice diameter of 0.2 inch/5.0 mm.

7. The two component development system of claim 1, wherein the surfactant-polymer composition is sodium lauryl sulfate-poly(methylmethacrylate), (SLS-PMMA).

8. The two component development system of claim 1, wherein the coating is present in a range from about 1.0 to about 1.5 percent by weight of the toner carrier particle.

9. The two component development system claim 1, wherein the average toner particle size of the particle is about 5.0 to about 6.0 microns.

10. The toner particle of claim 1, wherein the average circularity index of the toner particle is about 0.970 or greater.

11. The two component development system claim 1, wherein a silica with an average primary particle size of about 30 nm to about 50 nm and silica with an average primary particle size of about 110 nm to about 130 nm are used as an external toner additive in a ratio of about 1:1.

12. The two component development system claim 11, wherein the total silica additive amount is in a range from about 2.5 to about 4 percent by weight of toner.

13. The two component development system of claim 1, wherein the system is designed to operate at a toner concentration in a range from about 4 parts per hundred (pph) to about 9 pph.

14. A two component development system comprising
a plurality of toner particles comprising a colorant; and
a plurality of toner carrier particles comprising
a magnetic carrier core having a $D_{50}$ diameter in a range from about 30 microns to about 40 microns; and a sodium lauryl sulfate-poly(methylmethacrylate), (SLS-PMMA) coating, the coating being present in an amount in a range from about 0.5 percent by weight to about 1.5 percent by weight of the toner carrier particle, wherein the system is designed to operate at a toner concentration in a range from about 4 parts per hundred (pph) to about 9 pph.

15. The two component development system claim 14, wherein a silica with an average primary particle size of about 30 nm to about 50 nm and silica with an average primary particle size of about 110 nm to about 130 nm are used as an external toner additive in a ratio of about 1:1.

16. The two component development system claim 15, wherein the total silica additive amount is in a range from about 2.5 to about 4 percent by weight of toner.

17. A two component development system comprising
a plurality of toner particles comprising a colorant;
wherein a silica with an average primary particle size of about 30 nm to about 50 nm and a silica with an average primary particle size of about 110 nm to about 130 nm are used as an external toner additive in a ratio of about 1:1, wherein the total silica additive amount is in a range from about 2.5 to about 4 percent by weight of toner; and
a plurality of toner carrier particles comprising
a magnetic carrier core having a $D_{50}$ diameter in a range from about 30 microns to about 40 microns; and a sodium lauryl sulfate-poly(methylmethacrylate), (SLS-PMMA) coating, the coating being present in an amount in a range from about 0.5 percent by weight to about 1.5 percent by weight of the toner carrier particle.

* * * * *